United States Patent [19]

Takimoto

[11] Patent Number: 4,854,000

[45] Date of Patent: Aug. 8, 1989

[54] CLEANER OF REMOTE-CONTROL TYPE

[76] Inventor: Nobuko Takimoto, No.6-19, Higashi Takasago-cho, Urawa-shi, Saitama-ken, Japan

[21] Appl. No.: 268,542

[22] Filed: Nov. 7, 1988

[30] Foreign Application Priority Data

May 23, 1988 [JP] Japan ..... 63-67808[U]

[51] Int. Cl.[4] ..... A47L 9/00

[52] U.S. Cl. ..... 15/3; 15/104 A; 15/339; 15/340.1

[58] Field of Search ..... 15/3, 104 A, 339, 340.1

[56] References Cited

U.S. PATENT DOCUMENTS

| | | | |
|---|---|---|---|
| 3,742,547 | 7/1973 | Sohmer | 15/104 A |
| 4,083,075 | 4/1978 | Hestor | 15/104 A |
| 4,306,329 | 12/1981 | Yokoi | 15/339 X |
| 4,369,543 | 1/1983 | Chen et al. | 15/339 X |
| 4,562,610 | 1/1986 | Davis et al. | 15/228 |
| 4,640,539 | 2/1987 | La Porte | 15/104 A X |

*Primary Examiner*—Chris K. Moore

*Attorney, Agent, or Firm*—Browdy and Neimark

[57] ABSTRACT

A cleaner of remote-control type is disclosed, which comprises a cleaner body A which includes a movement means having front wheels 2 and rear wheels 3, a dust collecting means 4 comprising an adhesive-backed roller provided at the front lower portion of the cleaner body and a receiver 7, and a transmitter B which includes a power means 8 such as a battery, a power switch 9, a movement controller 10 for controlling forward, stop and backward movements and a direction controller 11 for controlling left-turn, straight drive and right-turn.

1 Claim, 1 Drawing Sheet

CLEANER OF REMOTE-CONTROL TYPE

FIELD OF THE INVENTION

This invention relates to a cleaner of wireless remote-control type capable of operating at a distance or from one's seat.

BACKGROUND OF THE INVENTION

Conventional vacuum cleaners have been used by carrying in hand a hose or a pipe being an inlet port for collecting dust as well as walking around a predetermined place to clean.

With regard to a handy cleaning tool of hand roller type as shown in FIG. 3, on the other hand, a user goes ahead pressing the roller down to the floor with the grip in hand to rotate the roller provided at the end of the cleaning tool and stick dust on the surface thereof in order to collect duct.

When running a conventional vacuum cleaner or cleaning tool as hereinbefore described, a user must walk around therewith and further bend his body. This results in physical fatigue, for which reason he thought very troublesome to clean therewith.

Accordingly, the invention aims to provide a cleaner of wireless remote-control type capable of automatically cleaning by operating at a distance or from one's seat.

SUMMARY OF THE INVENTION

In order to achieve the above object, the invention provides a cleaner of remote-control type comprising a cleaner body which includes a movement means having front wheels and rear wheels, a dust collecting means comprising an adhesive-backed roller provided at the front lower portion of the cleaner body and a receiver, and a transmitter which includes a power means such as a battery, a power switch, a movement controller for controlling forward, stop and backward movements and a direction controller for controlling left-turn, straight drive and right-turn.

For better understanding, the invention will now be described hereinbelow in more detail with reference to the accompanying drawings.

PREFERRED EMBODIMENTS OF THE INVENTION

Figure 1:
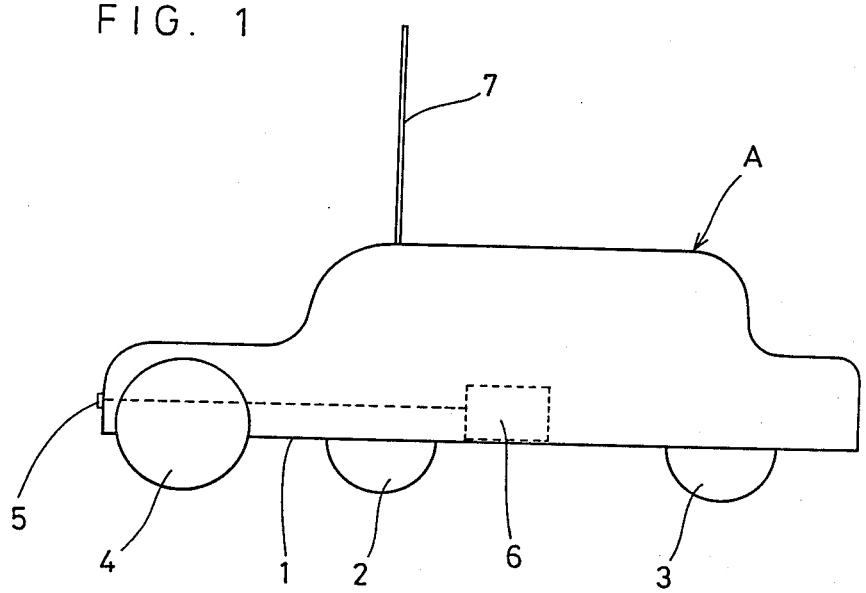
FIG. 1 is a side view of a cleaner of remote-control type according to the invention.
Figure 2:
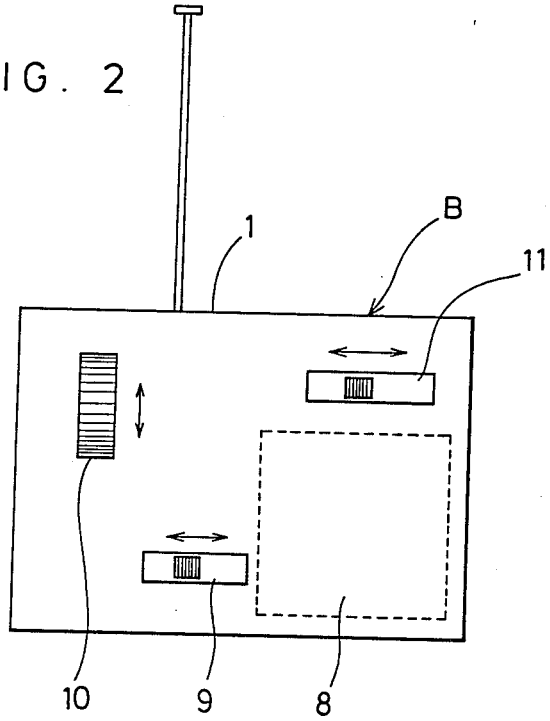
FIG. 2 is a plan view of a transmitter.
Figure 3:
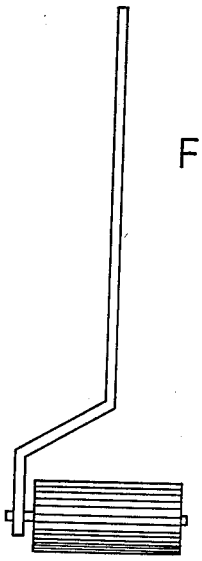
FIG. 3 is a front view of a conventional cleaner of hand roller type.

A numerical reference 1 represents a cleaner of remote-control type according to the invention, which comprises a cleaner body A provided with a movement means having front wheels 2 and rear wheels 3, a dust collecting means 4 attached at the front lower portion of the cleaner body, a sensor 5 located at the end portion of the cleaner body for sensing the contact with predetermined obstacles, a direction-converting apparatus 6 connected to the sensor 5, and a receiver 7 for catching the signals from a transmitter so as to automatically move the cleaner of remote-control type, and a transmitter B for transferring the cleaner body A.

As the dust collecting means 4, a roller removable from the cleaner body A is employed, the surface of which is provided with an adhesive-backed paper. Through rotation of the adhesive-backed roller, the dust, ticks, anther dust, feces of ticks, bacteria and noxious particles, such as one injurious to the lungs, on the floor may be adhered thereto. Particularly, although a tick is about the size of $\frac{1}{3}$ mm, it stings or bites the human body to develop allergy, thereby causing asthma, dermatitis, conjunctivitis or nasitis and the like. When a predetermined volume of such ticks and other dusts adheres to the adhesive-backed paper, a user tears the adhesive-backed paper off from the surface of the roller so as to conveniently continue to carry out the same cleaning operation by the use of the following adhesive-backed paper.

The moment the sensor 5 provided at the end of the cleaner body A connects to any obstacle such as a wall and a door, the direction-converting apparatus 6 actuates the front wheels 2 to reverse rotatively by a predetermined angle. As a result, the cleaner body A backs. After backing by a predetermined distance, the direction-converting apparatus 6 automatically actuates the front wheels 2 to rotate by a predetermined angle for restoring at the former location. Then, the front wheels 2 reverse, resulting in a conversion of the running direction of the cleaner body A so as to proceed with the cleaning operations.

The transmitter B, on the other hand, comprises a power means 8 such as a battery, a power switch 9, a movement controller 10 for controlling forward, stop and backward movements and a direction controller 11 for controlling left-turn, straight drive and right-turn. Accordingly, the transmitter B may freely control forward and backward speed or control left and right directions. Therefore, as hereinbefore described, it is possible to clean a room while automatically travelling the cleaner body A as well as freely controlling the travelling speed and direction by means of the movement controller 10 and the direction controller 11.

The cleaner of remote-control type thus constructed may freely move by means of a wireless control system to proceed with cleaning operations at a distance or from one's seat, resulting in a pleasant cleaning operation without a physical fatigue. Furthermore, it may automatically convert the travelling direction when contacting with obstacles such as a wall and a door. A dust collecting means is provided at the front portion of the cleaner body, while the body is formed so as to be narrow and low, so that it is possible to clean over the places difficult to sweep such as a corner of a floor and the lower side of a bed. On the other hand, it has neither long pipe nor hose unlike the conventional one, so that it is possible to conveniently keep and handle when not used.

The cleaner according to the invention may automatically move as hereinbefore described, while it may freely change the travelling speed and direction by means of a transmitter, so that a child and a person other than a housewife also may pleasantly clean a room while being at play or a housewife may clean a room while playing with her child.

Furthermore, an adhesive-backed roller is employed, thereby raising no dust by the cleaning operation or cleaning under a healthful circumstance. Unlike the conventional cleaner, the cleaner according to the invention may utilize no vacuum power through a motor, resulting in no noice and quiet cleaning.

What is claimed is :

1. A cleaner of remote-control type comprising a cleaner body A which includes a movement means having front wheels 2 and rear wheels 3, a dust collecting means 4 comprising an adhesive-backed roller provided at the front lower portion of the cleaner body, and a receiver 7, and a transmitter B which includes a power means 8 such as a battery, a power switch 9, a movement controller 10 for controlling forward, stop and backward movements and a direction controller 11 for controlling left-turn, straight drive and right-turn.

* * * * *